US006988933B2

(12) United States Patent
Yoritsune et al.

(10) Patent No.: US 6,988,933 B2
(45) Date of Patent: Jan. 24, 2006

(54) TRUING METHOD AND APPARATUS

(75) Inventors: Masashi Yoritsune, Anjo (JP); Yoshio Wakazono, Nagoya (JP); Hisanobu Kobayashi, Hoi-gun (JP)

(73) Assignee: Toyoda Koki Kabushiki Kaisha, Kariya (JP)

( * ) Notice: Subject to any disclaimer, the term of this patent is extended or adjusted under 35 U.S.C. 154(b) by 0 days.

(21) Appl. No.: 11/052,801

(22) Filed: Feb. 9, 2005

(65) Prior Publication Data

US 2005/0191944 A1 Sep. 1, 2005

(30) Foreign Application Priority Data

Mar. 1, 2004 (JP) ..... 2004-056685

(51) Int. Cl.
*B24B 53/00* (2006.01)

(52) U.S. Cl. ..... 451/5; 451/21; 451/56

(58) Field of Classification Search ..... 451/5, 451/8, 10, 11, 21, 28, 56, 51
See application file for complete search history.

(56) References Cited

U.S. PATENT DOCUMENTS 5,006,685 A * 4/1991 Hatano et al. ..... 219/69.2
5,177,901 A * 1/1993 Smith ..... 451/72
6,248,003 B1 * 6/2001 Hoshiya et al. ..... 451/56
6,616,508 B1 * 9/2003 Kamamura et al. ..... 451/8
2003/0204287 A1 * 10/2003 Shirakawa et al. ..... 700/193

FOREIGN PATENT DOCUMENTS

JP 2749154 2/1998

* cited by examiner

*Primary Examiner*—Jacob K. Ackun, Jr.
(74) *Attorney, Agent, or Firm*—Oblon, Spivak, McClelland, Maier & Neustadt, P.C.

(57) ABSTRACT

In a truing method and apparatus, an analyzing method is employed to calculate a truing shape from which a grinding surface having been trued with a grinding wheel being rotated at a low rotational speed during a truing operation is deformed to a desired shape due to centrifugal expansion depending on a rotational speed difference when the grinding wheel is rotated at a high rotational speed during a grinding operation. Then, with the grinding wheel being rotated at the low rotational speed, the grinding surface is trued with a truing roll to the calculated truing shape. As a result, the grinding surface of the grinding wheel being rotated at the low rotational speed is trued with the truing roll taking into consideration the centrifugal expansion of the grinding surface which takes place when the grinding wheel is rotatated at the high rotational speed during the grinding operation subsequent to the truing operation.

8 Claims, 3 Drawing Sheets

TRUING METHOD AND APPARATUS

This application claims priority under 35 U.S.C. 119 with respect to Japanese Application No. 2004-056685 filed on Mar. 1, 2004.

BACKGROUND OF THE INVENTION

1. Field of the Invention

The present invention relates to a truing method and apparatus for truing a grinding surface of a grinding wheel with a truing roll being rotationally driven.

2. Discussion of the Related Art

Japanese Patent No. 2749154 describes a truing apparatus for a grinding machine in which a rotating grinding wheel and a rotating workpiece are relatively moved to grind the workpiece with the grinding wheel. In the grinding machine, a work spindle is rotatably supported on a work head for supporting the workpiece, a chuck device for gripping the workpiece and a truing roll for truing the grinding wheel are in turn fixed on an extreme end of the work spindle in alignment, and the grinding wheel and the work head are moved relatively in two directions orthogonal to each other to true the grinding surface of the grinding wheel with the truing roll.

In a recent grinding machine equipped with a grinding wheel using CBN (Cubic Boron Nitride) abrasive grain, the grinding wheel is rotated at a high speed so that the circumferential speed of the grinding wheel is increased to enhance the grinding efficiency. The ratio in circumferential speed of the grinding wheel to the truing roll is set conventionally in a range of 0.75 to 0.8 in order to true the grinding wheel to be sharp. For example, where the circumferential speed of the grinding wheel is set to 120 m/s (meter per second), the rotational speed of the truing roll would be set to a range of 15,000 to 20,000 $min^{-1}$ (revolutions per minute) because the diameter of the truing roll is 100 mm (millimeters) or so. This would require that the truing roll be mounted on a rotational spindle which is able to be rotated at an extremely high speed.

Since the work spindle of the work head is not able to be rotated at such a high speed, it is practiced in place of the truing apparatus described in the aforementioned Japanese patent that a rotational spindle rotatable by a built-in motor at a high speed is supported on an apparatus main body and that a truing apparatus with a truing roll mounted on an end of the rotational spindle is attached to a lateral surface of the wheel head facing the grinding wheel. However, this truing apparatus is required to rotate the rotational spindle at such a high speed and gives rise to a problem that the apparatus becomes a large scale to increase the cost. Further, since the grinding wheel has to be retracted through a long distance at the time of a truing operation, the moving stroke of the grinding wheel is elongated thereby to enlarge the grinding machine. In addition, the high speed rotation of the rotational spindle causes the truing apparatus to increase heat generation, and such heat is conducted to the work head and the bed. As a consequence, a thermal displacement is brought about, e.g., between the axis of the rotational spindle with the truing roll mounted thereon and the axis of the work spindle, so that an error may be involved in the distance between the grinding wheel surface which has to be trued with the truing roll and the axis of the work spindle.

SUMMARY OF THE INVENTION

Accordingly, it is a primary object of the present invention to provide an improved truing apparatus wherein a grinding surface of a grinding wheel is trued with a truing roll, with the grinding wheel being rotationally driven at a relatively low rotational speed taking into consideration centrifugal expansion which takes place on the grinding surface of the grinding wheel when the same is rotatated at a high rotational speed during a grinding operation.

Briefly, according to the present invention, there is provided a truing method and apparatus for truing a grinding surface of a rotating grinding wheel with a rotating truing roll by moving the truing roll and the grinding wheel relatively in first and second directions crossing with each other in a grinding machine wherein a wheel head rotatably carrying the grinding wheel and a work head rotatably carrying a workpiece are relatively moved to grind the workpiece with the grinding wheel. The truing method and apparatus comprises a step and means for inferring a truing shape from which the grinding surface having been trued with the grinding wheel being rotated at a low rotational speed during a truing operation is deformed to a desired shape due to centrifugal expansion depending on a rotational speed difference when the grinding wheel is rotated at a high rotational speed during a grinding operation. The method and apparatus further comprises a step and means for preparing a truing NC program which is programmed to rotate the grinding wheel at the low rotational speed and to relatively move the grinding wheel and the truing roll along the truing shape and a step and means for executing the truing NC program to rotate the grinding wheel at the low rotational speed and to move the grinding wheel and the truing roll relatively so that the grinding surface is trued with the truing roll.

With this construction, inference is made to determine the truing shape from which the grinding surface having been trued with the grinding wheel being rotated at the low rotational speed during the truing operation is deformed to the desired shape due to the centrifugal expansion depending on the rotational speed difference when the grinding wheel is rotated at the high rotational speed during the grinding operation. Then, the grinding surface of the grinding wheel being rotated at the lower rotational speed is trued with the truing roll to the inferred truing shape. Thus, according to the truing method, the rotational speed of a rotational spindle with the truing roll mounted thereon can be set to be low. This advantageously makes it possible to downsize the truing apparatus or to mount the truing roll on the work spindle coaxially. Further, since the rotational spindle with the truing roll mounted thereon does not need to be rotated at a high speed, heat generation which would otherwise result from the high speed rotation of the truing roll can be suppressed to prevent the work head and a bed from being thermally displaced due to the conduction of heat thereto, so that the machining accuracy can be improved. In addition, according to the truing apparatus, it can be realized to true the grinding surface of the grinding wheel being rotated at the low rotational speed, with the truing roll being rotated at the low rotational speed so that the trued grinding surface becomes the desired shape when the grinding wheel is then rotated at the high rotational speed for the grinding operation for example. Therefore, it can be realized to provide the truing apparatus which is less in heat generation and precise.

BRIEF DESCRIPTION OF THE ACCOMPANYING DRAWINGS

The foregoing and other objects and many of the attendant advantages of the present invention may readily be appreciated as the same becomes better understood by reference to the preferred embodiment of the present invention when considered in connection with the accompanying drawings, wherein like reference numerals designate identical or corresponding parts throughout the several views, in which.

Figure 3:
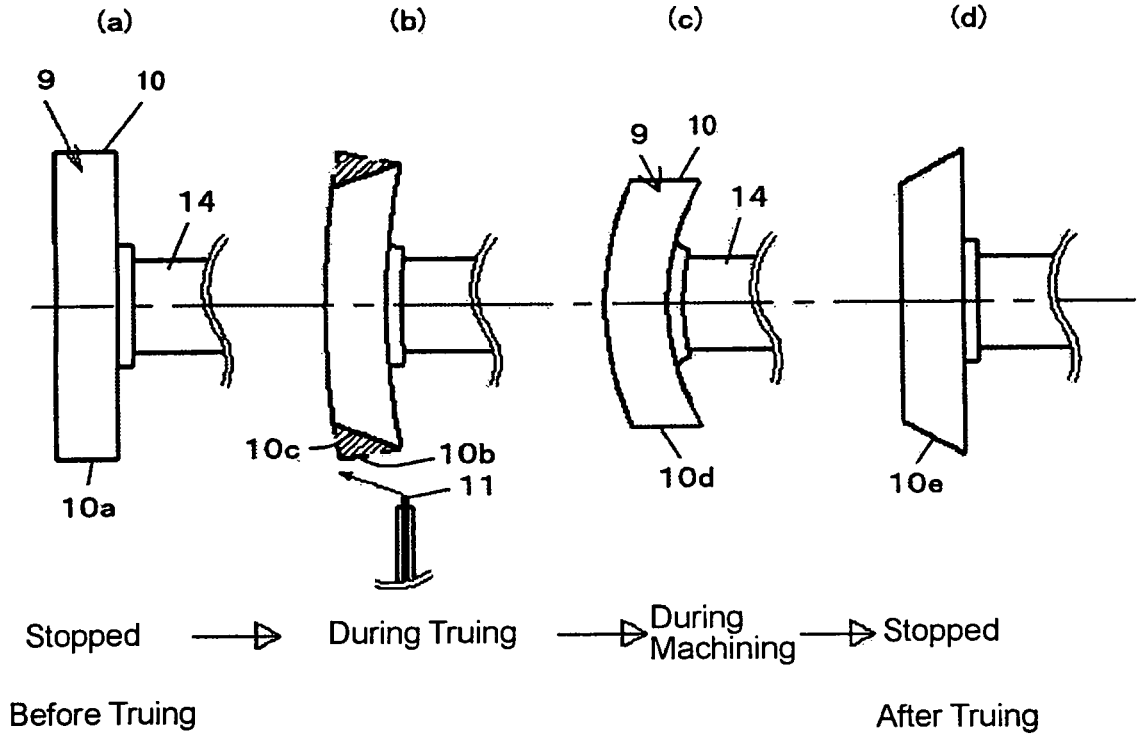
Figure 4:
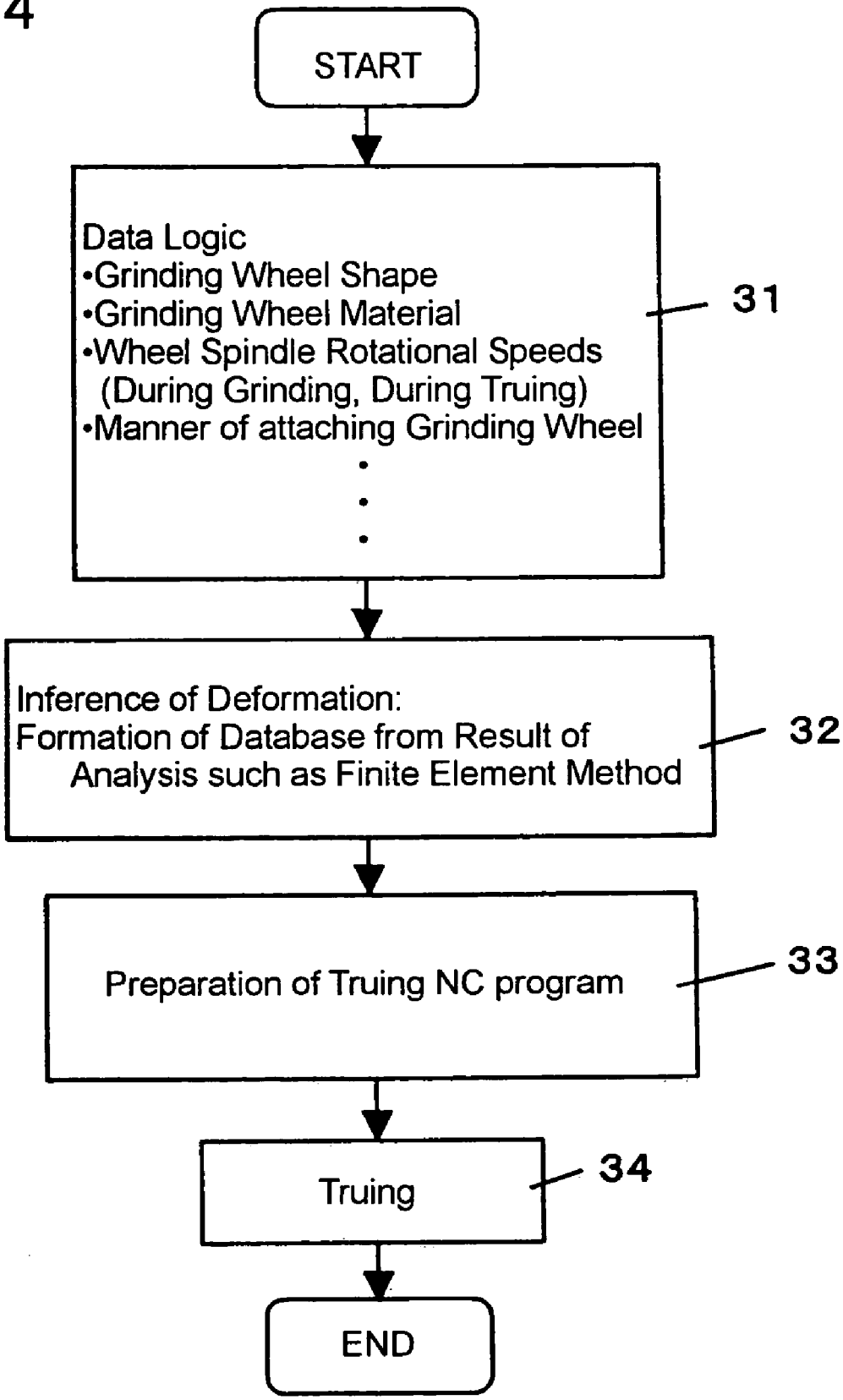

FIGS. 3(*a*)–(*d*) are explanatory views illustrating the deformation of the grinding wheel due to centrifugal expansion in an exaggerated scale; and FIG. 4 is a flow chart showing procedural steps in a truing operation.

DETAILED DESCRIPTION OF THE PREFERRED EMBODIMENT

Figure 1:
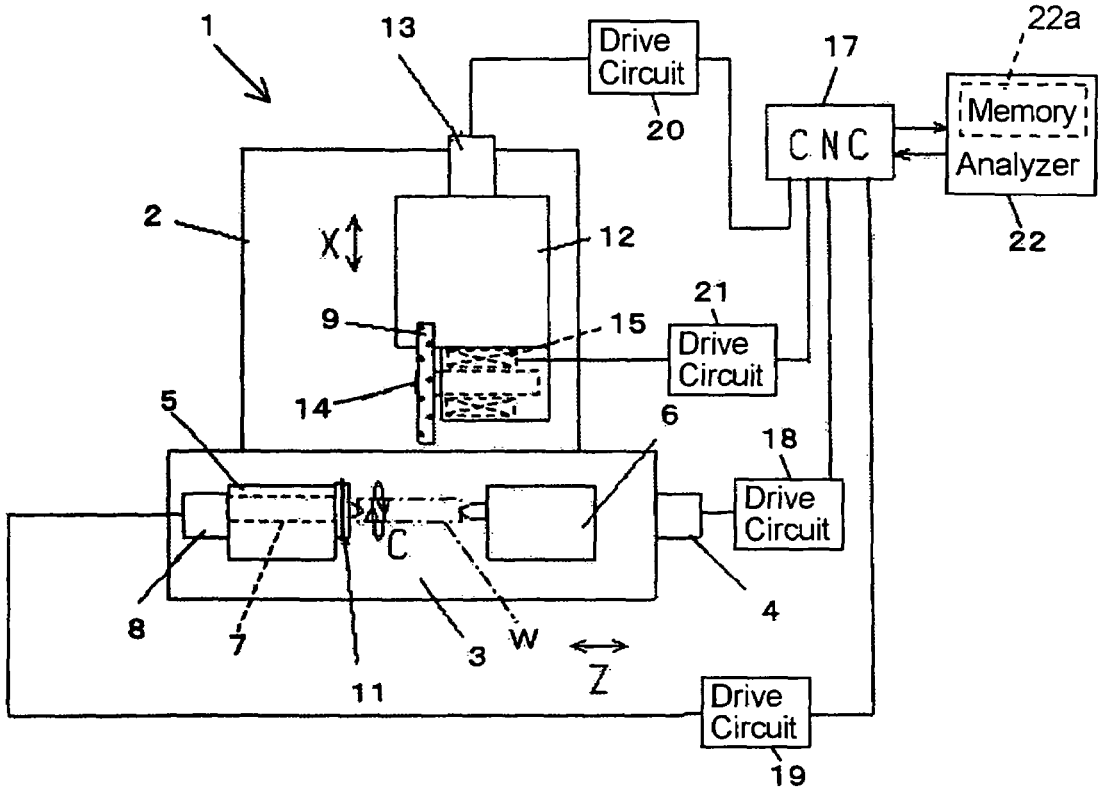
FIG. 1 is a schematic plan view of a grinding machine with a truing apparatus in one embodiment according to the present invention.

Hereinafter, an embodiment in a truing method and apparatus according to the present invention will be described in detail with reference to the accompanying drawings. Referring now to FIG. 1, a table 3 is slidably mounted on a bed 2 of a grinding machine 1 and is movable by a servo motor 4 through a ball screw (not shown) in a Z-axis direction. A work head 5 and a foot stock 6 are mounted on the table 3 to face with each other, and a workpiece W is sustained by means of centers (not shown) between the work head 5 and the foot stock 6 in the Z-axis direction. A work spindle 7 is rotatably carried on the work head 5 to be rotationally driven by a servo motor 8. The workpiece W is kept in a drive connection with the work spindle 7 by means of a drive member (not shown) and is rotationally driven together with the work spindle 7. A truing roll 11 for truing a grinding wheel 9 referred to later is coaxially secured to an extreme end portion of the work spindle 7.

Figure 2:
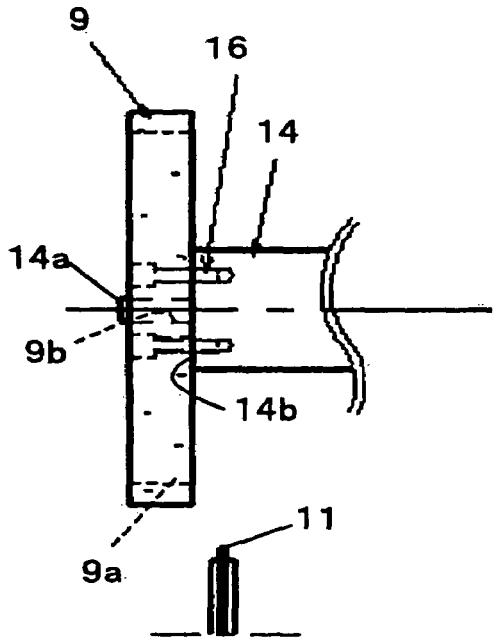
FIG. 2 is an explanatory view showing a manner of attaching a grinding wheel to a wheel spindle.

On the bed 2, there is slidably mounted a wheel head 12, which is movable by a servo motor 13 through a ball screw (not shown) in an X-axis direction extending perpendicular to the Z-axis. A wheel spindle 14 is rotatably carried on the wheel head 12 and is drivable by a built-in motor 15. The wheel spindle 14 has attached thereto a grinding wheel 9 of the type that an abrasive layer constituted by bonding CBN abrasive grains with vitrified bond is mounted on a circumferential surface of a disc-like core. Regarding the manner of attaching the grinding wheel 9 onto the wheel spindle 14, as shown as one example in FIG. 2, a center bore 9*b* formed in the core 9*a* of the grinding wheel 9 is fitted on a small-diameter shaft portion 14*a* protruding from the extreme end of the wheel spindle 14 to bring the core 9*a* into contact engagement with a shoulder portion 14*b*, and bolts 16 are inserted into bolt holes formed in the core 9*a* to extend in the axial direction and are screwed securely into the shoulder portion 14*b*, whereby the grinding wheel 9 is attached to the wheel spindle 14.

A CNC (Computerized Numerical Control) controller 17 is connected to drive circuits 18 to 21 for the servo motors 4, 8, 13 and the built-in motor 15. The CNC controller 17 successively executes steps of a grinding NC program during a grinding operation. That is, it outputs a rotational command to the drive circuit 21 for the built-in motor 15 for rotating the grinding wheel 9 at a high rotational speed, and also outputs another rotational speed to the drive circuit 19 for the servo motor 8 for rotating the workpiece W at a circumferential speed suitable to the grinding operation. Then, the CNC controller 17 outputs a feed command to the drive circuit 18 for the servo motor 4 for moving the table 3 in the Z-axis direction to the position where the workpiece W comes to face the grinding wheel 9 and outputs another command to the drive circuit 20 for the servo motor 13 for advancing the wheel head 12 at a grinding feed rate in the X-axis direction, whereby the workpiece W can be ground with the grinding wheel 9. When the workpiece W is ground to have a predetermined size, a command is output to the drive circuit 20 for the servo motor 13, whereby the servo motor 13 is reversely driven to retract the wheel head 12 at a rapid feed rate in the X-axis direction.

The CNC controller 17 executes a truing NC program during a truing operation. That is, it outputs a rotational command to the drive circuit 21 for the built-in motor 15 for rotating the grinding wheel 9 at a low rotational speed and also outputs another rotational command to the drive circuit 19 for the servo motor 8 which rotationally drives the work spindle 7, for rotating the truing roll 11 reversely relative to the grinding wheel 9 at a low rotational speed suitable for truing. Subsequently, an advance command is output to the drive circuit 20 for the servo motor 13 for infeeding the wheel head 12 in the X-axis direction, whereby the grinding surface 10 of the grinding wheel 9 is advanced by a truing infeed amount against the circumferential surface of the truing roll 11. A feed command is further output to the drive circuits 18 and 20 for the servo motors 4, 13 for relatively moving the table 3 and the wheel head 12 along a truing shape to be made at a truing feed rate, whereby the grinding surface 10 of the grinding wheel 9 is trued with the truing roll 11.

Where the grinding wheel 9 is trued as it is rotated at such a high rotational speed as 5, 500 $min^{-1}$ (i.e., 5, 500 revolutions per minute) or so to set the wheel circumferential speed of the grinding wheel 9 to 120 m/s during the grinding operation, the rotational speed of a truing roll 9 with the diameter of 100 mm or so has to be set to a range of 15,000 to 20,000 $min^{-1}$ in order to keep the ratio in circumferential speed of the grinding wheel 9 to the truing roll 11 in a range of 0.75 to 0.8. In the present embodiment, however, the grinding wheel 9 is rotated at such a low rotational speed as 1,000 $min^{-1}$ or so during the truing operation so that the ratio in circumferential speed of the grinding wheel 9 to the truing roll 11 can be set in the range of 0.75 to 0.8 even with the truing roll 11 being rotated at such a low rotational speed as 3,000 $min^{-1}$ or so.

However, when the grinding wheel 9 is rotated at the high rotational speed for grinding operation after the grinding wheel 9 being rotated at the low rotational speed is trued with the truing tool 11, the difference between the rotational speeds causes the grinding wheel 9 to deform as shown in FIG. 3(*c*) due to centrifugal expansion. This is because one side surface of the grinding wheel 9 is restricted by the shoulder portion 14*b* of the wheel spindle 14, so that each of various portions of the grinding wheel 9 has a smaller deformation amount (i.e., smaller expansion amount) as it comes close to the wheel spindle 14. Therefore, the degree of a warp of the grinding wheel 9 changes between the truing operation (low rotational speed) shown in FIG. 3(*b*) and the grinding operation (high rotational speed) shown in FIG. 3(*c*). To cope with this, an analyzer 22 is connected to the CNC controller 17. In an analyzing method, the analyzer 22 calculates a truing shape 10*c*_for each kind of grinding wheels 9 which are probable to be selectively attached to the wheel spindle 14, and stores the calculated truing shape 10*c* in a memory 22*a* thereof in connection with the kind of each grinding wheel 9. The truing shape 10*c* is inferred as the shape from which the grinding surface 10 of the grinding wheel 9 which have been trued as being rotatated at the low rotational speed is deformed by centrifugal expansion due to the rotational speed difference between the low rotational speed during the truing operation and the high rotational speed during the grinding operation, to a desired shape 10*d* when the grinding wheel 9 is rotated at the high rotational speed during the grinding operation. More specifically, the analyzer 22 has input thereto the shape and material of the grinding wheel 9, the rotational speeds of the grinding wheel 9 during the grinding operation and the truing operation, the manner of attaching the grinding wheel 9 to the wheel spindle 14 and the like and calculates the truing shape 10*c* by the use of an analyzing method such as Finite Element Method or the like.

For example, although the shape 10*a* of the grinding surface 10 of the grinding wheel 9 being kept stopped is parallel to the Z-axis as shown in FIG. 3(*a*), the grinding surface 10 is expansively deformed due to the centrifugal force to be inclined as indicated at 10*b* in FIG. 3(*b*) when the grinding wheel 9 is rotated at the low rotational speed during the truing operation, and is further inclined during the grinding operation. Thus, taking into consideration the fact that the difference between deformation amounts due to the centrifugal expansion is caused by the rotational speed difference between the low rotational speed during the truing operation and the high rotational speed during the grinding operation, the grinding wheel 9 is trued to the truing shape 10*c* shown in FIG. 3(*b*) which is inclined in a direction opposite to that in which it is inclined by the centrifugal expansion. As a consequence, when the grinding wheel 9 is rotated at the high rotational speed during the grinding operation, the grinding surface 10 becomes the desired shape 10*d* parallel to the Z-axis as shown in FIG. 3(*c*). When the grinding wheel 9 so trued is then stopped, the grinding surface 10 takes a shape 10*e* which is inclined in a direction opposite to that in which it is inclined due to the centrifugal expansion, as shown in FIG. 3(*d*). The operation or calculation that the analyzer 22 carries out for the truing shape 10*c* by utilizing the analyzing method such as Finite Element Method or the like is made to come close the reality by compensating the difference between the operation result and an experimental result.

The analyzer 22 outputs to the CNC controller 17 the truing shape 10*c* being such an analyzed result, e.g., the inclination angle which the direction of relative movement of the truing roll 11 to the grinding wheel 9 makes with respect to the Z-axis. The CNC controller 17 is provided with an NC program preparation function of preparing a truing NC program based on the truing shape 10*c*, the low rotational speed of the grinding wheel 9, the low rotational speed of the truing roll 11, and dimensions regarding the diameter, width and the like of the grinding wheel 9 being attached to the wheel spindle 14. The truing NC program is designed to rotate the grinding wheel 9 at the low rotational speed for the truing operation, to rotate the work spindle 7 with the truing roll 11 fixed thereon at the low rotational speed suitable for the truing operation, and to move the grinding wheel 9 and the truing roll 11 relatively along the truing shape 10*c*.

The CNC controller 17 executes the truing NC program prepared as aforementioned. That is, the CNC controller 17 outputs a rotational command to the drive circuit 21 for the built-in motor 15 to rotate the grinding wheel 9 at the low rotational speed, outputs a rotational command to the drive circuit 19 for the servo motor 8 to rotate the truing roll 11 at the low rotational speed, and outputs a feed command to the drive circuits 18, 20 for the servo motors 4, 13 to move the grinding wheel 9 and the truing roll 11 relatively along the truing shape 10*c*. As a result, the grinding surface 10 of the grinding wheel 9 can be trued with the truing roll 11 to the truing shape 10*c*.

(Operation)

Next, the operation of the embodiment as constructed above will be described with reference to a flow chart for the truing operation shown in FIG. 4. For each of various grinding wheels 9 which are probable to be used in the grinding machine 1, the analyzer 22 has input thereto the shape and material of the grinding wheel 9, the rotational speeds of the grinding wheel 9 during the grinding operation and the truing operation, the manner of attaching the grinding wheel 9 to the wheel spindle 14, and the like (procedural step 31). The analyzer 22 calculates the truing shapes 10*c* for the various grinding wheels 9 by the use of the analyzing method such as Finite Element Method or the like and stores the calculated truing shapes 10*c* in the memory 22*a* thereof in connection with the kinds of the grinding wheels to form a database therefor (procedural step 32). The memory 22*a* serves as inference date storage means. After the truing shapes 10*c* are stored in the memory 22*a* and the kind of a selected grinding wheel 9 having been attached to the grinding machine 1 is designated thereto, the CNC controller 17 reads out_from the memory 22*a* the truing shape 10*c* corresponding to the designated grinding wheel 9 and prepares the truing NC program based on the shape of the designated grinding wheel 9, the rotational speeds of the designated grinding wheel 9 and the truing roll 11, and the like (procedural step 33). Then, the CNC controller 17 executes the prepared truing NC program, in accordance with which the grinding wheel 9 and the truing roll 11 are rotated at the respective low rotational speeds and are relatively moved along the read-out truing shape 10*c*, whereby the grinding surface 10 of the grinding wheel 9 can be trued to the read-out truing shape 10*c*.

(Modifications)

Although in the foregoing embodiment, the analyzer 22 and the CNC controller 17 are made to be independent of each other, they may be replaced as one controller by providing the CNC controller 17 with the function of the analyzer 22.

In the foregoing embodiment, the analyzer 22 which calculates the truing shape 10*c* by the use of the analyzing method such as Finite Element Method or the like is employed to serve as inference means for inferring the truing shape 10*c*. This inferred truing shape 10*c* is the shape from which the grinding surface 10 having been trued with the grinding wheel 9 being rotated at the low rotational speed during the truing operation is deformed to the desired shape 10*d* due to the centrifugal expansion depending on the rotational speed difference when the grinding wheel 9 is rotated at the high rotational speed during the grinding operation. Instead, the inference means may be constituted to define the truing shapes 10*c* for various grinding wheels 9 in dependence on an experimental principle or through experiments, to gather them as a database and to infer the truing shape based on the database. In this modified case, the memory 22*a* stores inference data on the truing shapes 10*c* for such various kinds of grinding wheels 9 which are probable to be selectively attached to the wheel spindle 14.

Also in the foregoing embodiment, the present truing method and apparatus is applied where the grinding wheel 9 is attached by means of bolts 16 to an end portion of the wheel spindle 14 which is carried by bearings in the form of a cantilever. However, the present truing method and apparatus can also be applied even where the grinding wheel 9 is carried with both side surfaces thereof held pressured on an intermediate portion of a wheel spindle whose opposite ends are supported by respective bearings. This is because in this case, the degree of a warp of the grinding wheel 9 changes between the truing operation (low rotational speed) and the grinding operation (high rotational speed) in dependence on the difference in contact areas of those surfaces which restrict the both side surfaces of the grinding wheel 9. Further, the present truing method and apparatus can also be applied even where a grinding wheel 9 is attached on the wheel spindle in such a way that a taper portion is formed on a wheel spindle which is carried in the form of a cantilever or both end supports and that the grinding wheel is secured by means of a nut with the taper portion tightly fit in a taper hole formed on the center of the grinding wheel. In this case, the rigidity of the grinding wheel becomes different in the axial direction by the influence of the taper bore, which causes the degree of the warp of the grinding wheel to vary in dependence on the rotational speed.

Various features and many of the attendant advantages in the foregoing embodiments will be summarized as follows:

In the truing method in the foregoing embodiment typically shown in FIGS. 1 and 4, inference is made at procedural step 32 to determine a truing shape 10*c* from which the grinding surface 10 having been trued with the grinding wheel 10 being rotated at the low rotational speed during the truing operation is deformed to the desired shape 10*d* due to centrifugal expansion depending on the rotational speed difference when the grinding wheel 9 is rotated at the high rotational speed during the grinding operation. Then, with the grinding wheel 9 being rotated at the low rotational speed, the grinding surface 10 is trued with the truing roll 11 to the inferred truing shape 10*c*. Thus, according to the truing method, the rotational speed of the work spindle 7 mounting the truing roll 11 thereon can be set to be low. This advantageously makes it possible to downsize the truing apparatus or to mount the truing roll 11 coaxially on the work spindle 7. Further, since the work spindle 7 mounting the truing roll 11 thereon does not need to be rotated at the high rotational speed, heat generation which would otherwise result from the high speed rotation of the truing roll 11 can be suppressed to prevent the work head 5 and the bed 2 from being thermally displaced due to the conduction of heat thereto, so that the machining accuracy can be improved.

Also in the truing method in the foregoing embodiment typically shown in FIG. 4, since the truing shape 10*c* is inferred by calculation in an analyzing method, it can be realized to easily infer the truing shape 10*c* which becomes to the desired shape 10*d* when the grinding wheel 9 is expanded due to centrifugal force, in adaptation to an alteration in the grinding wheel shape or the like.

In the truing apparatus in the foregoing embodiment shown in FIGS. 1, 3 and 4, inference is made to determine the truing shape 10*c* from which the grinding surface 10 having been trued with the grinding wheel 9 being rotated at the low rotational speed during the truing operation is deformed to the desired shape 10*d* due to centrifugal expansion depending on the rotational speed difference when the grinding wheel 9 is rotated at the high rotational speed during the grinding operation. Then, with the grinding wheel 9 being rotated at the low rotational speed, the grinding surface 9 is trued with the truing roll 11 to the inferred truing shape 10*c*. Thus, it can be realized to true the grinding surface 10 of the grinding wheel 9 being rotated at the low rotational speed, with the truing roll 11 being rotated at the low rotational speed so that the trued grinding surface 10*c* becomes the desired shape 10*d* when the grinding wheel 9 is then rotated at the high rotational speed. Therefore, it can be realized to provide the truing apparatus which is less in heat generation and precise.

Also in the truing apparatus in the foregoing embodiment typically shown in FIG. 4, since the truing shape 10*c* is inferred by calculation in an analyzing method, it can be realized to provide the truing apparatus which is capable of easily inferring the truing shape 10*c* which becomes the desired shape 10*d* when the grinding wheel 9 is expanded due to centrifugal force, in adaptation to an alteration in the grinding wheel shape or the like and of then truing the grinding surface 10 of the grinding wheel 9 to the inferred truing shape 10*c*.

Further, in the truing apparatus in the foregoing embodiment shown in FIGS. 1, 3 and 4, with respect to each kind of grinding wheels, inference data storage means 22*a* stores inference data on the truing shape 10*c* from which the grinding surface 10 having been trued with the grinding wheel 9 being rotated at the low rotational speed during the truing operation is deformed to the desired shape 10*d* due to centrifugal expansion depending on the rotational speed difference when the grinding wheel 9 is rotated at the high rotational speed during the grinding operation. Then, NC program preparation means 33 prepares the truing NC program based on the inference data which corresponds to the kind of the grinding wheel 9 being carried on the wheel head 12, and NC controller 17 executes the truing NC program to true the grinding surface 10 of the grinding wheel 9 being rotated at the low rotational speed, with the truing roll 11 to the inferred truing shape 10*c*. Thus, it can be realized to true the grinding surface 10 of the grinding wheel 9 being rotated at the low rotational speed, with the truing roll 11 being rotated at the low rotational speed so that the trued grinding surface 10*c* becomes the desired shape 10*d* when the grinding wheel 9 is then rotated at the high rotational speed. Therefore, it can be realized to provide the truing apparatus which is less in heat generation and precise.

Also, in the truing apparatus in the foregoing embodiment typically shown in FIGS. 1 and 3, since the centrifugal expansion of the grinding wheel 9 when the same is rotated at the high rotational speed during the grinding operation is taken into consideration, under which the grinding surface 10 of the grinding wheel 9 being rotated at the low rotational speed can be trued with the truing roll 11 being rotated at the low rotational speed, it can be realized to mount the truing roll 11 on the work spindle 7 rotatably carried on the work head 5, in axial alignment with the workpiece W. Therefore, it becomes unnecessary to retract the grinding wheel 9 through a long distance for the truing operation, so that the moving stroke of the grinding wheel 9 can be shortened thereby to downsize the grinding machine 1.

Obviously, numerous modifications and variations of the present invention are possible in light of the above teachings. It is therefore to be understood that within the scope of the appended claims, the present invention may be practiced otherwise than as specifically described herein.

What is claimed is:

1. A truing method of truing a grinding surface of a rotating grinding wheel with a rotating truing roll by moving the truing roll and the grinding wheel relatively in first and second directions crossing with each other in a grinding machine wherein a wheel head rotatably carrying the grinding wheel and a work head rotatably carrying a workpiece are relatively moved to grind the workpiece with the grinding wheel, the truing method comprising the steps of:

inferring a truing shape from which the grinding surface having been trued with the grinding wheel being rotated at a low rotational speed during a truing operation is deformed to a desired shape due to centrifugal expansion depending on a rotational speed difference when the grinding wheel is rotated at a high rotational speed during a grinding operation;

preparing a truing NC program which is programmed to rotate the grinding wheel at the low rotational speed and to relatively move the grinding wheel and the truing roll along the truing shape; and executing the truing NC program to rotate the grinding wheel at the low rotational speed and to move the grinding wheel and the truing roll relatively so that the grinding surface is trued with the truing roll.

2. The truing method as set forth in claim 1, wherein the truing shape is inferred by calculation in an analyzing method.

3. A truing apparatus for truing a grinding surface of a rotating grinding wheel with a rotating truing roll by moving the truing roll and the grinding wheel relatively in first and second directions crossing with each other in a grinding machine wherein a wheel head rotatably carrying the grinding wheel and a work head rotatably carrying a workpiece are relatively moved to grind the workpiece with the grinding wheel, the apparatus comprising:

inference means for inferring a truing shape from which the grinding surface having been trued with the grinding wheel being rotated at a low rotational speed during a truing operation is deformed to a desired shape due to centrifugal expansion depending on a rotational speed difference when the grinding wheel is rotated at a high rotational speed during a grinding operation;

NC program preparation means for preparing a truing NC program which is programmed to rotate the grinding wheel at the low rotational speed and to relatively move the grinding wheel and the truing roll along the truing shape; and NC control means for executing the truing NC program to rotate the grinding wheel at the lower rotational speed and to move the grinding wheel and the truing roll relatively so that the grinding surface is trued with the truing roll.

4. The truing apparatus as set forth in claim 3, wherein the inference means infers the truing shape by calculation in an analyzing method.

5. The truing apparatus as set forth in claim 3, wherein the truing roll is mounted on a work spindle, which is rotatably carried on the work head for rotationally driving the workpiece, in axial alignment with the workpiece.

6. A truing apparatus for truing a grinding surface of a rotating grinding wheel with a rotating truing roll by moving the truing roll and the grinding wheel relatively in first and second directions crossing with each other in a grinding machine wherein a wheel head rotatably carrying the grinding wheel and a work head rotatably carrying a workpiece are relatively moved to grind the workpiece with the grinding wheel, the apparatus comprising:

inference data storage means for storing, with respect to each kind of grinding wheels, inference data on a truing shape from which the grinding surface having been trued with the grinding wheel being rotated at a low rotational speed during a truing operation is deformed to a desired shape due to centrifugal expansion depending on a rotational speed difference when the grinding wheel is rotated at a high rotational speed during a grinding operation;

NC program preparation means for preparing a truing NC program, which is programmed to rotate the grinding wheel at the low rotational speed and to relatively move the grinding wheel and the truing roll along the truing shape, based on the inference data stored in the inference data storage means in correspondence to the kind of the grinding wheel being carried on the wheel head; and NC control means for executing the truing NC program to rotate the grinding wheel at the lower rotational speed and to move the grinding wheel and the truing roll relatively so that the grinding surface is trued with the truing roll.

7. The truing apparatus as set forth in claim 6, wherein the inference data storage means stores an analyzed result which is obtained by calculation in analyzing the truing shape in an analyzing method, with respect to each kind of the grinding wheels.

8. The truing apparatus as set forth in claim 6, wherein the truing roll is mounted on a work spindle which is rotatably carried on the work head for rotationally driving the workpiece, in axial alignment with the workpiece.

* * * * *